US007180002B2

(12) United States Patent
Bertges et al.

(10) Patent No.: US 7,180,002 B2
(45) Date of Patent: Feb. 20, 2007

(54) FLEXIBLE MULTICORE ELECTRICAL CABLE

(76) Inventors: Harald Bertges, Netzestrabe 16, D-41189 Monchengladbach (DE); Heinz-Willi Hamacher, Hocksteiner Kirchweg 31a, D-41189 Monchengladbach (DE); Walter Winkelbauer, Manteuffelstrabe 11, D-47057 Duisburg (DE)

( * ) Notice: Subject to any disclaimer, the term of this patent is extended or adjusted under 35 U.S.C. 154(b) by 0 days.

(21) Appl. No.: 11/259,377

(22) Filed: Oct. 26, 2005

(65) Prior Publication Data

US 2006/0131062 A1 Jun. 22, 2006

(30) Foreign Application Priority Data

Oct. 29, 2004 (EP) ..... 04292581

(51) Int. Cl.
*H01B 5/08* (2006.01)

(52) U.S. Cl. ..... 174/128.1; 174/128.2

(58) Field of Classification Search ..... 174/128.1, 174/128.2

See application file for complete search history.

(56) References Cited

U.S. PATENT DOCUMENTS 2,098,162 A * 11/1937 Reed ..... 174/128.1
4,196,307 A 4/1980 Moore et al. ..... 174/47
4,538,022 A * 8/1985 Barnicol-Ottler et al. ..... 174/113 R
4,657,342 A * 4/1987 Bauer ..... 385/103
4,689,444 A * 8/1987 Burgess ..... 174/128.1
4,719,319 A * 1/1988 Tighe, Jr. ..... 174/103
5,408,560 A 4/1995 Seynhaeve et al. ..... 385/101
6,140,589 A * 10/2000 Blackmore ..... 174/128.1
6,362,432 B1 * 3/2002 LaPidus et al. ..... 174/113 R

OTHER PUBLICATIONS

European Search Report- Apr. 14, 2005.
Elektrodienst 25- 1983.

* cited by examiner

*Primary Examiner*—Chau Nguyen N.
(74) *Attorney, Agent, or Firm*—Sofer & Haroun, LLP

(57) ABSTRACT

The invention describes a flexible multicore electrical cable with a central supporting member (3), several cores (1) that includes insulated fine-strand conductors and surround the supporting member (3), and a plastic sheath (5), wherein the central supporting member (3) includes a torsionally rigid steel cable (3*a*), which is provided with an outer layer of insulation (3*b*). The steel cable (3*a*) includes a core strand (6), a first course of several strands (7) stranded on the core strand (6), and a second course of several strands (10) stranded on the first course, wherein the direction of lay and/or the length of lay of the strands (10) of the second course is different from the direction of lay and/or the length of lay of the strands (7) of the first course.

5 Claims, 2 Drawing Sheets

FLEXIBLE MULTICORE ELECTRICAL CABLE

RELATED APPLICATION

This application is related to and claims the benefit of priority from European Patent Application No. 04 292 581.8, filed on Oct. 29, 2004, the entirety of which is incorporated herein by reference.

Field of the Invention

The object of the present invention is a flexible multicore electrical cable.

BACKGROUND

Flexible cables are used, e.g., as electric power lines for moving machines, in which the cables can be wound on drums or dragged. They are used at surface mining sites and underground mining sites.

In the design of cables of this type, it is necessary to optimize the expansion behavior of the conductors for small bend radii and to provide the cable with sufficient tensile strength.

The German journal "Elektrodienst", 1983, No. 1, pp. 26–27, describes an elevator control cable, in which the cores are stranded around a supporting member to form a cable core, and the cable core is surrounded by a plastic sheath. The previously known cable is distinguished by a cable structure in which five cores are stranded around a core with high tensile strength to form a bundle, and six of these bundles are then arranged with a short length of lay around the supporting member, which is designed as a torsion-free steel cable. The advantages of this design are:

high flexural fatigue strength, high flexibility, and absolute stability of the core construction

OBJECTS AND SUMMARY

The objective of the present invention is to make available a cable that can be wound on a drum and used for power transmission and/or data transmission, can be subjected to very high dynamic tensile loads, and can thus be used under harsh underground conditions.

Due to the structure of the steel cable, which has high tensile strength and torsional rigidity, a fracture of the cable elements occurs in the central courses of the steel cable after an extremely long period of use, so that premature damage of the cores is avoided.

BRIEF DESCRIPTION OF THE INVENTION

The invention is explained below in greater detail with reference to the specific embodiments shown schematically in FIGS. 1 and 2.

DETAILED DESCRIPTION

Figure 1:
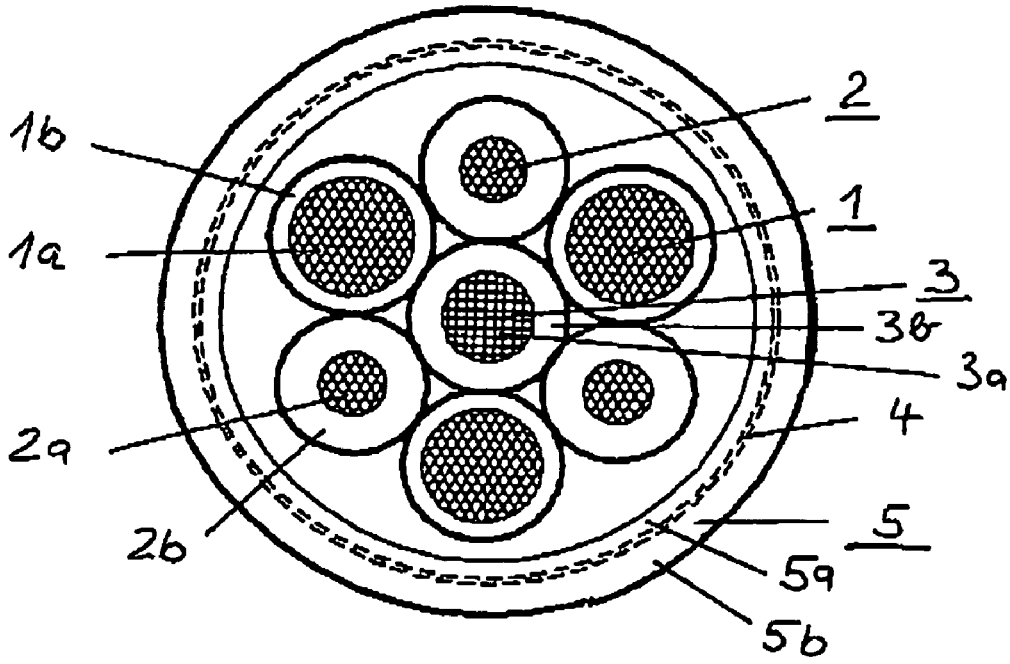
FIG. 1 shows a cross section of a cable in accordance with the invention.

FIG. 1 shows a cross section of a cable in accordance with the invention. The cable has three main cores 1, which consist of a highly-flexible fine-strand copper conductor 1*a* and an insulating layer 1*b* based on EPR. Between the main cores 1, there are protective conductors 2, which, like the main cores 1, have a highly flexible, fine-strand copper conductor 2*a* and an insulating layer 2*b* based on EPR. In the center of the cable, there is a supporting member 3, which has a torsionally rigid steel cable 3*a* and an insulating rubber sheath 3*b*. The sheath 5 consists of two layers 5*a* and 5*b*, between which an antitorsion mesh 4 is provided. It is advantageous for the layers 5*a* and 5*b* to consist of a chlorine-containing rubber that is resistant to oil, highly nonflammable, resistant to tear propagation, and resistant to abrasion. The antitorsion mesh 4 is made of synthetic fibers with high tensile strength and abrasion resistance.

The supporting member 3 can be advantageously used as a control conductor or as an overload control conductor.

The main cores 1 and protective conductors 2 are stranded on the supporting member 3.

Figure 2:
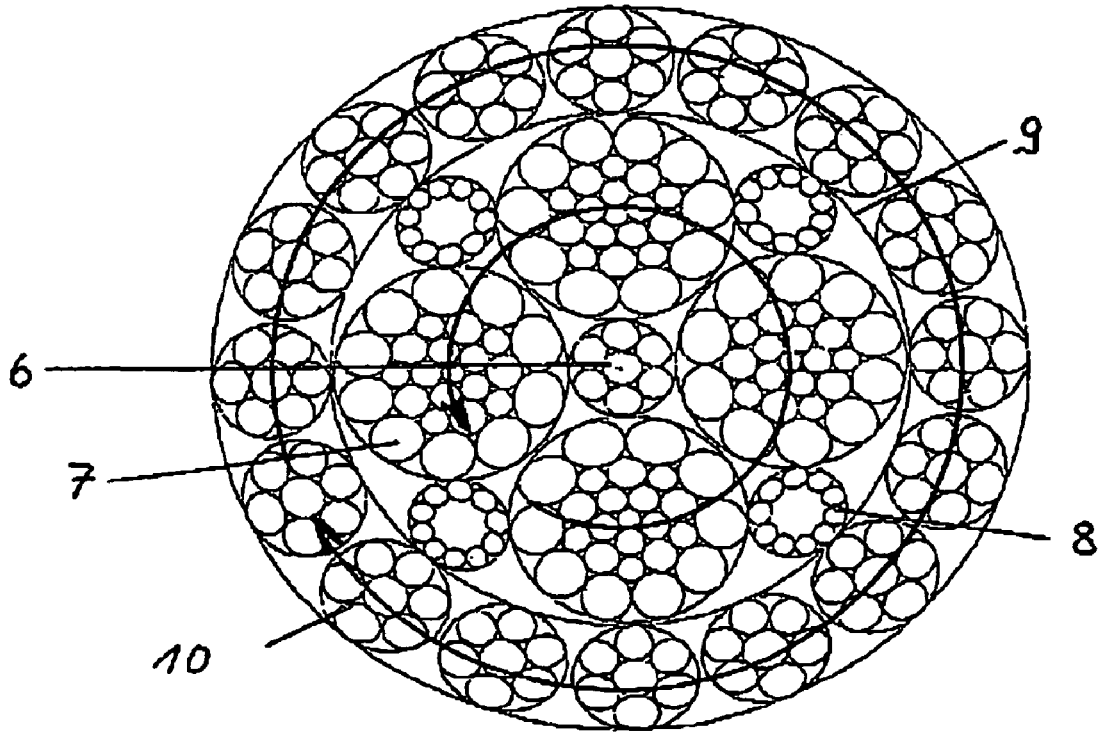
FIG. 2 shows the steel cable 3*a* on a larger scale.

FIG. 2 shows the steel cable 3*a* on a larger scale.

The steel cable 3*a* consists of a core strand 6, which consists, for example, of seven individual wires.

The core strand 6 is surrounded by four strands 7, each of which consists of twenty-six individual wires.

Four smaller strands 8 are provided in the gaps between the strands 7. The diameters of the strands 7 and 8 are adjusted relative to each other in such a way that they are tangent to a common surrounding sheath 9. An outer course is formed by sixteen outer strands 10, which, like the core strand 6, consist of seven individual wires each.

Figure 3:
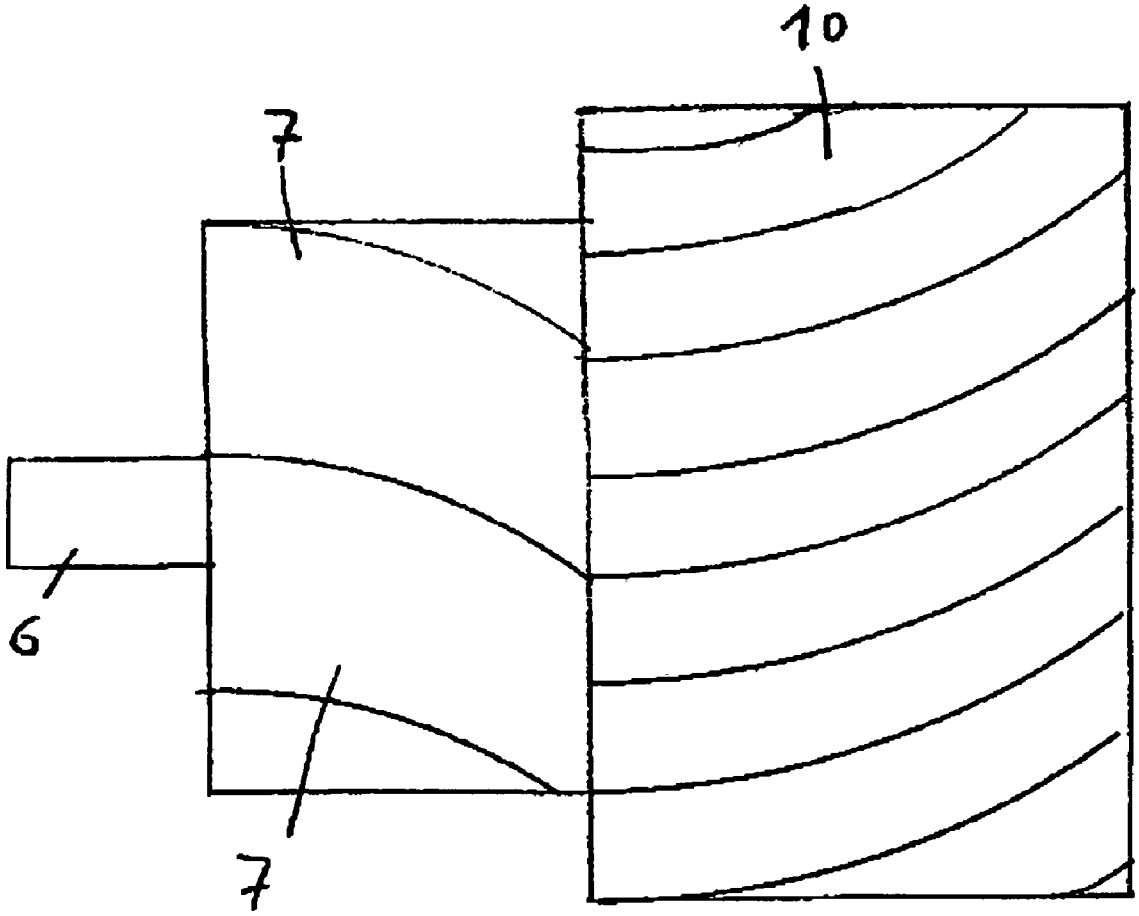
FIG. 3 shows a side view of steel cable 3*a* in which the length and direction of lay of the first course is different than the length and direction of lay of the second course.

The strands 7 of the first course are stranded on the core strand 6 with a length of lay of 35 mm. The outer strands 10 of the second course are stranded on the first course with a length of lay of 50 mm and with a reversed lay from that of the first course. FIG. 3 shows a side view in which the direction of lay of the first count 7 is different from that of the second course 10.

The supporting member constructed in this way gives the cable an extremely high flexural fatigue strength and thus a very long service life.

In the extreme case, the cable structure guarantees that the wires of the inner course fracture first and thus avoid or at least delay any damage to the main cores.

The invention claimed is:

1. Flexible multicore electrical cable comprising:

a central supporting member, several cores that include insulated fine-strand conductors and surround the supporting member, and an outer sheath, wherein the central supporting member includes a torsionally rigid steel cable, which is provided with an outer layer of insulation, wherein the steel cable includes a core strand, a first course of several strands stranded on the core strand, and a second course of several strands stranded on the first course, wherein the direction of lay and the length of lay of the strands of the second course is different from the direction of lay and the length of lay of the strands of the first course and the direction and length of lay for both the first and second courses are consistent throughout the entire length of the cable.

2. Multicore cable in accordance with claim 1, wherein additional strands are arranged in the stranding gaps of the first course, that the diameters of the additional strands are smaller than the diameters of the strands of the first course, and that the strands of the first course and the additional strands are tangent to a common surrounding sheath.

3. Multicore cable in accordance with claim 1, wherein protective conductors are arranged between the cores.

4. Multicore cable in accordance with claim 1, wherein the insulation of the cores includes ethylene-propylene rubber (EPR).

5. Multicore cable in accordance with claim 1, wherein the outer sheath includes two layers that are made of a rubber, and that an and-torsion mesh that is made of synthetic fibers with high tensile strength is embedded between the two layers.

* * * * *